US008357734B2

(12) United States Patent
Kokko

(10) Patent No.: US 8,357,734 B2
(45) Date of Patent: Jan. 22, 2013

(54) CREPING ADHESIVE WITH IONIC LIQUID

(75) Inventor: Bruce J. Kokko, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 1188 days.

(21) Appl. No.: 11/928,355

(22) Filed: Oct. 30, 2007

(65) Prior Publication Data

US 2008/0105394 A1 May 8, 2008

Related U.S. Application Data

(60) Provisional application No. 60/856,264, filed on Nov. 2, 2006.

(51) Int. Cl.
*C08K 5/07* (2006.01)
*B31F 1/12* (2006.01)

(52) U.S. Cl. ..... 524/58; 162/111

(58) Field of Classification Search ..... 524/58
See application file for complete search history.

(56) References Cited

U.S. PATENT DOCUMENTS

| | | | | |
|---|---|---|---|---|
| 3,994,771 | A | 11/1976 | Morgan, Jr. et al. | 162/113 |
| 4,102,737 | A | 7/1978 | Morton | 162/113 |
| 4,529,480 | A | 7/1985 | Trokhan | 162/109 |
| 5,187,219 | A | 2/1993 | Furman, Jr. | 524/377 |
| 5,370,773 | A | 12/1994 | Luu et al. | 162/111 |
| 6,187,137 | B1 | 2/2001 | Druecke et al. | 162/109 |
| 6,573,405 | B1 | 6/2003 | Abbott et al. | 564/292 |
| 6,900,313 | B2 | 5/2005 | Wasserscheid et al. | 544/59 |
| 6,911,114 | B2 | 6/2005 | Lindsay et al. | 162/112 |
| 6,991,707 | B2 | 1/2006 | Hill, Jr. et al. | 162/111 |
| 7,048,826 | B2 | 5/2006 | Archer et al. | 162/111 |
| 7,053,232 | B2 | 5/2006 | Moulton | 556/174 |
| 2003/0157351 | A1 | 8/2003 | Swatloski et al. | 428/478.4 |
| 2004/0060675 | A1 | 4/2004 | Archer et al. | 162/111 |
| 2004/0097755 | A1* | 5/2004 | Abbott et al. | 562/553 |
| 2004/0177940 | A1 | 9/2004 | Archer et al. | 162/199 |
| 2005/0006046 | A1 | 1/2005 | Boettcher et al. | 162/111 |
| 2005/0245669 | A1* | 11/2005 | Clungeon et al. | 524/515 |
| 2006/0188711 | A1* | 8/2006 | Kishioka et al. | 428/343 |
| 2006/0207722 | A1 | 9/2006 | Amano et al. | 156/327 |

OTHER PUBLICATIONS

Imperato et al., Chem. Commun., 1170-1172, Jan. 2005.*
Konig et al., Low-Melting Sugar-Urea-Salt Mixtures as Solvents for Diels-Alder Reactions, Chem. Commun. 2005, 1170-1172.

* cited by examiner

*Primary Examiner* — Hui Chin
(74) *Attorney, Agent, or Firm* — Laura L. Bozek

(57) ABSTRACT

The drying cylinder of a papermachine is provided a creping adhesive coating including a creping adhesive resin composition and a low temperature ionic liquid or a low temperature quasi-ionic liquid, the liquid being characterized by a melting temperature of 100° C. or less as well as low volatility.

37 Claims, 1 Drawing Sheet

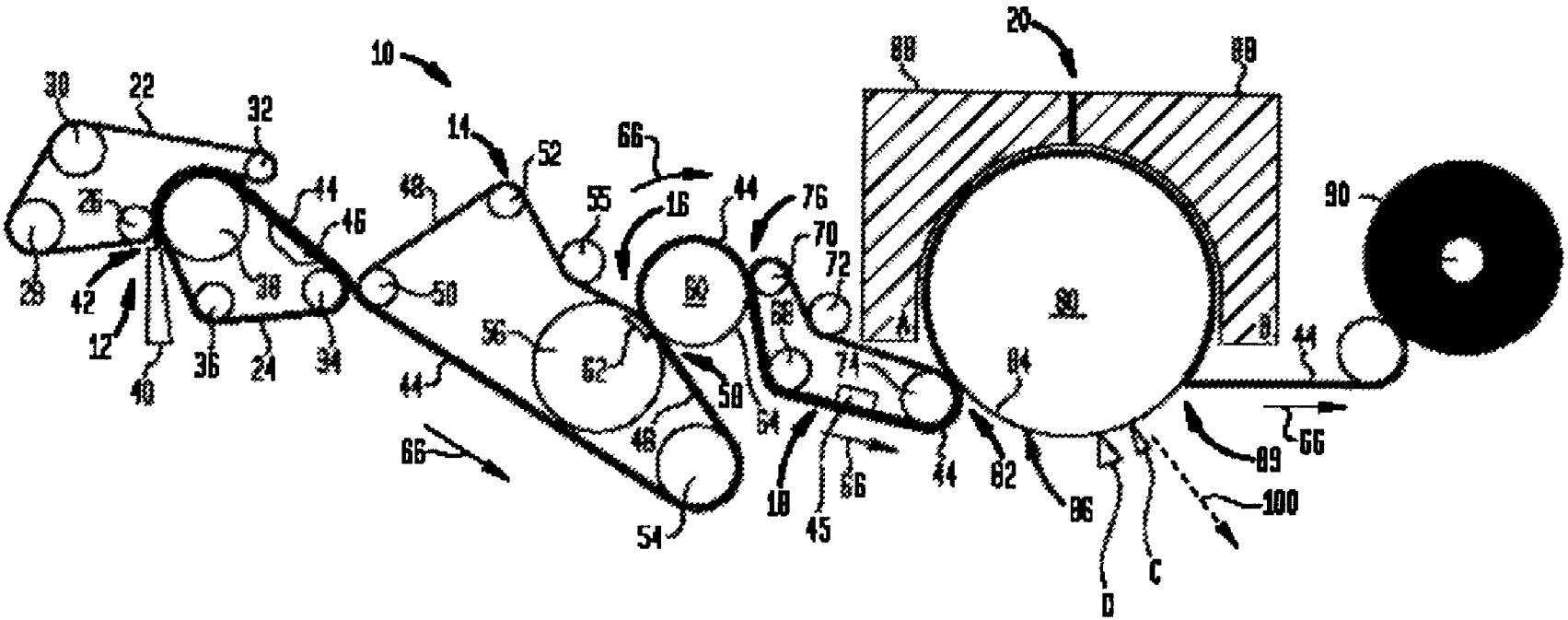
10
12
14
16
18
20
22
24
26
28
30
32
34
36
38
40
42
44
45
46
48
50
52
54
55
56
58
60
62
64
66
68
70
72
74
76
80
82
84
86
88
90
99
100
C
D

CREPING ADHESIVE WITH IONIC LIQUID

CLAIM FOR PRIORITY

This non-provisional application is based upon U.S. Provisional Patent Application Ser. No. 60/856,264, of the same title, filed Nov. 2, 2006. The priority of U.S. Provisional Patent Application Ser. No. 60/856,264 is hereby claimed and the disclosure thereof is incorporated into this application by reference.

TECHNICAL FIELD

The present invention generally relates to tissue and towel manufacture and more specifically to a creping adhesive coating for a drying cylinder of a papermachine including a low temperature ionic liquid and the use of these compositions in paper manufacture.

BACKGROUND

Methods of making paper tissue, towel, and the like are well known, including various features such as Yankee drying, throughdrying, fabric creping, dry creping, wet creping and so forth. Conventional wet pressing/dry creping processes (CWP) have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality tissue and towel products.

Throughdried, creped products and processes (TAD) are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%. See also, U.S. Pat. No. 6,187,137 to Druecke et al. which includes disclosure of peeling a web from a Yankee dryer.

Some newer processes including fabric-creping and the use of creping adhesives are described in the following co-pending applications: U.S. application Ser. No. 10/679,862, entitled "Fabric Crepe Process for Making Absorbent Sheet" which application, incorporated herein by reference, discloses particular papermachine details as well as creping techniques, equipment and properties; U.S. application Ser. No. 11/108,375, entitled "Fabric Crepe/Draw Process for Producing Absorbent Sheet" also incorporated herein by reference, provides still further processing and composition information; U.S. application Ser. No. 11/108,458, entitled "Fabric Crepe and In Fabric Drying Process for Producing Absorbent Sheet" and U.S. application Ser. No. 11/104,014, entitled "Wet-Pressed Tissue and Towel Products With Elevated CD Stretch and Low Tensile Ratios Made With a High Solids Fabric Crepe Process" both of which are incorporated herein by reference, provide some further variation as to selection of components and processing techniques. Another co-pending application, U.S. Ser. No. 11/451,111, filed Jun. 12, 2006, entitled "Method of Making Fabric-Creped Sheet for Dispensers", incorporated herein by reference, provides information on suitable drying and other manufacturing techniques.

It is well-known that a portion of the bulk of a paper web made by way of conventional wet pressing is usually imparted by creping wherein the creping adhesive coating plays an important role. Generally, the level of adhesion of the papermaking web to a dryer cylinder is also of importance as it relates to transfer of the web to a drying cylinder as well as control of the web in between the dryer and the reel upon which a roll of the paper is being formed. Webs which are insufficiently adhered may blister or, even worse, become disengaged from a drying cylinder and cause a hood fire. Moreover, insufficient wet-tack may lead to a transfer failure wherein the web fails to transfer to a drying cylinder and remains imbedded in a fabric causing shutdowns and waste of material and energy. Further, the level of adhesion of the papermaking web to the dryer is of importance as it relates to the drying of the web. Higher levels of adhesion reduce the impedance to heat transfer and cause the web to dry faster, enabling more energy efficient, higher speed operation; provided excessive build-up of adhesive is avoided. Note, however that some build-up is desirable inasmuch as adhesion of the sheet to the dryer occurs largely by means of creping adhesive coating deposited in previous passes.

It is important that the adhesive on the dryer remains wettable and excess deposits are avoided. Likewise, the tack properties must be sufficient, but not excessive, since the web needs to be removed from the drying cylinder.

Attempts to improve the performance of creping adhesives, including various approaches to the above-noted problems, have been described in the art. U.S. Pat. No. 7,048,826 to Archer et al., for example, describes a process of creping a fiber web wherein various creping adhesives and/or other performance additives are applied to certain zones on the surface of the creping cylinder. The zones are divided on the surface of the cylinder based on differences in the surface temperature under standard operating conditions, and the adhesives are selected to match the performance requirements in each zone. The process in Archer et al. reportedly improves inconsistencies in the adhesive coating, e.g., inconsistencies due to excessive adhesive build up or adhesive removal. A similar process is described in U.S. patent application Ser. No. 10/261,026 (Publication No. 2004/0060675) of Archer et al.

U.S. Pat. No. 6,991,707 to Hill, Jr. et al. relates to a method for manufacturing a creped fibrous web, where the creping adhesive on the drying cylinder comprises an ionene polymer. The ionene-containing adhesive is sprayed onto the creping cylinder in an aqueous medium. According to Hill, Jr. et al, the ionene adhesive improves runnability of the process because the ionene resins retain their adhesive properties over a wide range of moisture levels and temperatures.

Other references relevant to creping adhesives and creping processes include U.S. Pat. No. 6,911,114 to Lindsay et al., U.S. patent application Ser. No. 10/980,735 (Publication No. 2006/0090867) of Hermans et al See also, U.S. Pat. No. 5,187,219 to Furman, Jr.; U.S. patent application Ser. No. 10/806,205 (Publication No. 2004/0177940) of Archer et al., as well as U.S. patent application Ser. No. 10/833,473 (Publication No. 2005/0245669) of Clungeon et al.

Despite advances in the art, adhesive coatings on drying cylinders are exceedingly difficult to control in terms of build-up, re-wettability and tackiness because the coatings are largely water and dry concurrently with the wet paper.

SUMMARY OF INVENTION

The present invention is directed generally to the use of low temperature ionic liquids and related compositions to form an adhesive coating on a drying cylinder of a papermachine, such as a Yankee dryer. The liquids are essentially non-volatile and produce extremely robust coatings. One aspect of the present invention involves co-spraying an appropriate ionic or quasi-ionic liquid with a standard aqueous solution of a given creping adhesive system (e.g., polyvinyl alcohol/PAE) onto a hot Yankee surface (i.e., 120-150° C.) to achieve low moisture creped tissue while maintaining excellent adhesive polymer integrity, uniformity and tack, as is further discussed below.

BRIEF DESCRIPTION OF DRAWINGS

The invention is described in detail below with reference to the drawings wherein like numbers designate similar parts and wherein:

The FIGURE is a schematic diagram of a first papermachine suitable for practicing a process of the present invention.

DETAILED DESCRIPTION

The invention is described in detail below with reference to several embodiments and numerous examples. Such discussion is for purposes of illustration only.

Terminology used herein is given its ordinary meaning consistent with the exemplary definitions set forth immediately below; mg refers to milligrams and $m^2$ refers to square meters, mBar means milliBar (1/1000 Bar) and so forth. Unless otherwise specified, % means weight percent.

The creping coating "add-on" rate is calculated by dividing the rate of application of coating (mg/min) by surface area of the drying cylinder passing under a spray applicator boom ($m^2$/min).

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally wet strength resins, debonders and the like for making paper products.

The terminology "consisting essentially of" excludes additional components which substantially change the basic and novel characteristics of a composition. In the case of ionic and quasi-ionic liquids, "consisting essentially of" excludes components which substantially alter the melting point or vapor pressure of the composition.

Freezing point depressions of compositions are determined by calculating the melting point by rule of mixtures and subtracting the observed melting point of the composition.

In connection with the present invention, various water soluble or water swellable polymer materials may be used in the creping adhesive coatings as the creping adhesive resin including, without limitation, polyamidoamine-epichlorohydrin resins, polyamide-epichlorohydrin resins, poly(diallyamine)-epichlorohydrin resins, polyalkylene polyamine-epichlorohydrin resins, the reaction product of an epihalohydrin and an end-capped polyaminamide polymer, polyalkanolamides, the reaction product of (a) a mixture of polyamide and at least one of polyvinyl alcohol and low molecular weight polyethyleneimine, and (b) epihalohydrin, poly(vinyl alcohol), poly(vinyl alcohol)copolymers, polyacrylamide, polymethacrylamide which may be partially hydrolyzed, poly(acrylic acid), poly(methacrylic acid), poly (hydroxyethyl acrylate), poly(hydroxyethyl methacrylate), poly(N-vinyl pyrrolidinone), polyvinylamine, polyethyleneimine, poly(ethylene oxide), poly(ethylene glycol), ethylene-vinyl acetate copolymer, hydroxyethyl cellulose, hydroxpropyl cellulose, guar gum, starch, agar, alginic acid, chitosan, carboxymethyl cellulose, highly branched polyamidoamines, and silyl-linked polymers.

The above-mentioned polyamidoamine-epichlorohydrin resins may, if desired, bear polyol side chains, as described in U.S. Pat. No. 6,165,322 to Bower.

The above-mentioned polyamide-epichlorohydrin resins may be hydrophobically modified. Such modification can be achieved by reacting a polyamide-epichlorohydrin resin with an anionic polyelectrolyte, such as that made by reacting a polymeric compound having anhydride groups with a secondary amine having at least one fatty aliphatic group.

One class of adhesive materials includes cationic polymers having azetidinium, epoxide or hydroxyl functionalities, for example, polyamide-epichlorohydrin resin, poly(diallylamine)-epichlorohydrin resin, polyalkylene polyamine-epichlorohydrin resin, polyamidoamine-epichlorohydrin resin, polyvinyl alcohol or silyl-linked polymers such as silyl-linked polyamidoamines, as well as polyacrylamide, poly (ethylene oxide), poly(ethylene glycol), hydroxyethylcellulose, hydroxypropylcellulose, carboxymethylcellulose and guar gum.

Another class of adhesive materials includes non-self-crosslinkable polymers or oligomers which have functional groups that form hydrolyzable ionic cross-links with a suitable cross-linking agent. Cross-linking agents that can be used for this purpose are transition metal salts that provide ionic crosslinks between functional groups of the non-self-crosslinking polymer or oligomer. Zirconium salts have been found to be particularly useful cross-linking agents, with ammonium zirconium carbonate and potassium zirconium carbonate being preferred.

The term "non-self-crosslinkable polymer or oligomer," as used herein, refers to creping adhesive materials which have, or are modified to include, a crosslinked functional group such as a hydroxyl group, a carboxyl group, a sulfide group, a phosphate group, or a combination thereof. Representative examples of non-self-crosslinkable polymers or oligomers, which can be used in the composition of this invention, include polyvinyl alcohol, poly(acrylic acid), poly(methacrylic acid), partially hydrolyzed polyacrylamide, partially hydrolyzed polymethacrylamide, carboxymethylcellulose, alginic acid and polysaccharides such as starch, cellulose and cellulose derivatives, agar and guar gum. Further details regarding the preparation of creping adhesives comprising non-self-crosslinkable polymers or oligomers and transition metal-crosslinking agents are provided in U.S. Pat. No. 5,370,773 to Luu et al.

A preferred group of adhesive resins for use in the modified creping adhesive composition described herein includes at least one synthetic, natural or synthetically modified natural water soluble polymer, oligomer or copolymer selected from the group consisting of polyamidoamine-epichlorohydrin resins, polyamide-epichlorohydrin resins, poly(vinyl alcohol), highly branched polyamidoamines, and silyl-linked polyamidoamines.

Polyamide-epichlorohydrin resins suitable for use as creping adhesive resins are commercially available as Unisoft 805 (Hercules Corp., Wilmington, Del.) and Crepecel 690HA (Ondeo-Nalco, Naperville, Ill.). Polyamidoamine-epichlorohydrin ("PAE") resins useful in connection with the present invention may be added to the coatings or formulations in uncured or pre-crosslinked form. See U.S. patent application Ser. No. 10/409,042 (Publication No. 2005/0006040), of Boettcher et al., the disclosure of which is incorporated herein by reference. See also, U.S. patent application Ser. No. 10/833,473 (Publication No. 2005/0245669) of Clungeon et al., the disclosure of which is likewise incorporated herein by reference in its entirety. Polyvinyl alcohol resins suitable for use as a creping adhesive resins are available as Celvol 523, Celvol 540 and Celvol 205 (Celanese Corp., Dallas, Tex.), various grades of Elvanol™ polymers and copolymers (Du Pont, Wilmington, Del.), various grades of Mowiol™ (Clariant GmbH, Sulzbach, Germany) and CR-170 (Chemtreat, Inc., Glen Allen, Va.).

Creping adhesive resins compositions are usually prepared in an aqueous medium, where the resins are dissolved or dispersed in water. The aqueous creping adhesive composition should have a solids content such that the composition has a manageable viscosity; for example, it is desirable to use a creping adhesive composition that can be sprayed onto the creping cylinder.

Adhesive materials of the type described above have been described further in numerous patents and patent applications including, without limitation: U.S. Pat. Nos. 3,058,873, 3,640,841, 3,926,716, 4,075,177, 4,304,625, 4,501,640, 4,528,316, 4,584,439, 4,788,243, 5,179,150, 5,388,807, 6,133,405, 6,214,932, 6,214,932, 6,222,006, 6,277,242, and U.S. patent application Ser. No. 10/833,473 (Publication No. 2005/0245669), the disclosures of which are incorporated herein by reference.

"Low temperature ionic liquids," or "LTILs", refers to a molten composition including an ionic compound that is a stable liquid at temperatures of less than 100° C. at ambient pressure. Generally, such liquids have very low vapor pressure at 100° C., less than 75 mBar or so and preferably less than 50 mBar or 25 mBar at 100° C. Most suitable liquids will have a vapor pressure of less than 10 mBar at 100° C. and often the vapor pressure is so low it is negligible and is not easily measurable since it is less than 1 mBar at 100° C. The liquids may be a single compound, may include simple mixtures of two or more compounds, and optionally include reaction or decomposition products formed in situ. LTILs useful in connection with the present invention may be prepared by combining two or more individual component compounds, which are usually solid under ambient conditions, mixing them together and heating until they melt. The mixture remains a liquid upon cooling, preferably at least to 100° C. Still more preferably, the LTILs used in connection with the invention have melting points of less than 75° C., or less than 50° C., and most preferably are liquid at 25° C. Ionic liquids based on mixtures of two or more compounds useful in connection with the present invention typically exhibit significant freezing point depressions as compared with the rule of mixtures melting point of the constituent compounds. Preferred ionic liquids exhibit a freezing point depression of at least 25° C., preferably 75° C., and more preferably at least 150° C., based on the melting points and amounts of the individual components. For example, a eutectic composition of urea and choline chloride (2:1 molar ratio urea to choline choride) is a colorless liquid at room temperature and freezes at 12° C., which represents a freezing point depression of about 178° C. since the rule of mixtures melting point for this composition is roughly 190° C. (choline chloride has a melting point of 303° C. and urea has a melting point of 134° C.).

Ionic liquids as such are well known, and may be formed by complexing one or more organic cations from an organic salt, with a large metal anion and/or an organic anion from another salt compound. Some organic cations may also form ionic liquids with relatively simple anions such as halides, nitrates, sulfates, or the like. One or both of the anion or cation component in the ionic liquid may be large and asymmetrical, which promotes lower freezing points presumably because it is more difficult for the ions to fit into a solid lattice structure. Ionic liquids may also be prepared by combining an organic salt with a hydrogen bond donating agent such as urea or a carbohydrate (e.g., a saccharide) where the hydrogen bond donor generally complexes with the anion of the organic salt, thus lowering the melting point of the composition.

Suitable ionic liquids are disclosed in U.S. patent application Ser. No. 11/375,963 of Amans et al. (Pub. No. 2006/0207722), the disclosure of which is incorporated herein by reference. These ionic liquids include an onium cation and suitable anion. Typical cations include those of the following general structures:

Structure I

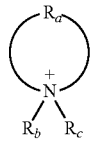

Structure II

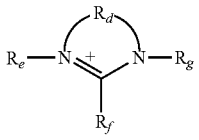

-continued

Structure III

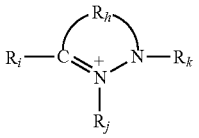

Structure IV

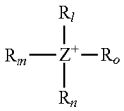

In the formula Structure I, $R_a$ represents a hydrocarbon group of a carbon number of 4 to 20, and may contain a hetero atom, and $R_b$ and $R_c$ are the same or different, represent hydrogen or a hydrocarbon group of a carbon number of 1 to 16, and may contain a hetero atom, provided that, when a nitrogen atom has a double bond, $R_c$ is not present.

In the formula Structure II, $R_d$ represents a hydrocarbon group of a carbon number of 2 to 20, and may contain a hetero atom, and $R_e$, $R_f$ and $R_g$ are the same or different, represent hydrogen or a hydrocarbon group of a carbon number of 1 to 16, and may contain a hetero atom.

In the formula Structure III, $R_h$ represents a hydrocarbon group of a carbon number of 2 to 20, and may contain a hetero atom, and $R_i$, $R_j$ and $R_k$ are the same or different, represent a hydrogen or a hydrocarbon group of a carbon number of 1 to 16, and may contain a hetero atom.

In the formula Structure IV, Z represents a nitrogen atom, a sulfur atom, or a phosphorus atom, and $R_l$, $R_m$, $R_n$ and $R_o$ are the same or different, represent a hydrogen atom or a hydrocarbon group of a carbon number of 1 to 20, and may contain a hetero atom, provided that, when Z is a sulfur atom, $R_c$ is not present. Specific compounds are enumerated in the '963 application. Suitable cations useful in LTILs include the following cations in substituted or unsubstituted form: ammonium; guanidium; pyridinium; pyridazinium; pyrimidinium; pyrazinium; imidazolium; pyrazolium; oxazolium; uronium; thiouronium; 1,2,3-triazolium; 1,2,4-triazolium; thiazolium; piperidinium; pyrrolidinium; quinolinium; and isoquinolinium. Further details as to suitable ionic liquids are found in U.S. patent application Ser. No. 10/256,521 of Swatloski et al., United States Publication No. 2003/0157351, the disclosure of which is incorporated herein by reference.

Suitable commercially available LTILs are Basionic™ ionic liquid products available from BASF (Florham Park, N.J.) and are listed in Table 1 below.

TABLE 1

Exemplary Ionic Liquids

| IL Abbreviation | Basionic ™ Grade | Product name | CAS Number |
|---|---|---|---|
| | | STANDARD | |
| EMIM Cl | ST 80 | 1-Ethyl-3-methylimidazolium chloride | 65039-09-0 |
| EMIM $CH_3SO_3$ | ST 35 | 1-Ethyl-3-methylimidazolium methanesulfonate | 145022-45-3 |
| BMIM Cl | ST 70 | 1-Butyl-3-methylimidazolium chloride | 79917-90-1 |
| BMIM $CH_3SO_3$ | ST 78 | 1-Butyl-3-methylimidazolium methanesulfonate | 342789-81-5 |
| MTBS | ST 62 | Methyl-tri-n-butylammonium methylsulfate | 13106-24-6 |
| MMMPZ $MeOSO_3$ | ST 33 | 1,2,4-Trimethylpyrazolium methylsulfate | |
| EMMIM $EtOSO_3$ | ST 67 | 1-Ethyl-2,3-di-methylimidazolium ethylsulfate | 516474-08-01 |
| MMMIM $MeOSO_3$ | ST 99 | 1,2,3-Trimethyl-imidazolium methylsulfate | 65086-12-6 |
| | | ACIDIC | |
| HMIM Cl | AC 75 | Methylimidazolium chloride | 35487-17-3 |
| HMIM $HSO_4$ | AC 39 | Methylimidazolium hydrogensulfate | 681281-87-8 |
| EMIM $HSO_4$ | AC 25 | 1-Ethyl-3-methylimidazolium hydrogensulfate | 412009-61-1 |
| EMIM $AlCl_4$ | AC 09 | 1-Ethyl-3-methylimidazolium tetrachloroaluminate | 80432-05-9 |
| BMIM $HSO_{4<}$/ | AC 28 | 1-Butyl-3-methylimidazolium hydrogensulfate | 262297-13-2 |
| BMIM $AlCl_4$ | AC 01 | 1-Butyl-3-methylimidazolium tetrachloroaluminate | 80432-09-3 |
| | | BASIC | |
| EMIM Acetat | BC 01 | 1-Ethyl-3-methylimidazolium acetate | 143314-17-4 |
| BMIM Acetat | BC 02 | 1-Butyl-3-methylimidazolium acetate | 284049-75-8 |
| | | LIQUID AT RT | |
| EMIM $EtOSO_3$ | LQ 01 | 1-Ethyl-3-methylimidazolium ethylsulfate | 342573-75-5 |
| BMIM $MeOSO_3$ | LQ 02 | 1-Butyl-3-methylimidazolium methylsulfate | 401788-98-5 |

TABLE 1-continued

| Exemplary Ionic Liquids | | | |
|---|---|---|---|
| IL Abbreviation | Basionic ™ Grade | Product name | CAS Number |
| LOW VISCOSITY | | | |
| EMIM SCN | VS 01 | 1-Ethyl-3-methylimidazolium thiocyanate | 331717-63-6 |
| BMIM SCN | VS 02 | 1-Butyl-3-methylimidazolium thiocyanate | 344790-87-0 |
| FUNCTIONALIZED | | | |
| COL Acetate | FS 85 | Choline acetate | 14586-35-7 |
| COL Salicylate | FS 65 | Choline salicylate | 2016-36-6 |
| MTEOA $MeOSO_3$ | FS 01 | Tris-(2-hydroxyethyl)-methylammonium methylsulfate | 29463-06-7 |

Preferred salts include (2-hydroxyethyl)trimethyl ammonium chloride (also called "choline chloride"). Choline chloride is mass produced as a vitamin additive in chicken feed, and is accordingly, a preferred option from a cost perspective as are readily available ammonium salts such as ammonium chloride or metal salts such as calcium chloride.

Some useful LTILs are disclosed by Konig et al., Chem. Commun. 2005, 1170-1172, the disclosure of which is incorporated herein by reference:

TABLE 2

| Stable melts of carbohydrates, urea and inorganic salts | | | |
|---|---|---|---|
| Melting points[a] | Carbohydrate | Urea | Salt |
| 65° C. | Fructose (60%)[b] | Urea (40%) | — |
| 67° C. | Sorbitol (70%) | Urea (20%) | $NH_4Cl$ (10%) |
| 73° C. | Maltose (50%) | DMU[c] (40%) | $NH_4Cl$ (10%) |
| 75° C. | Glucose (50%) | Urea (40%) | $CaCl_2$ (10%) |
| 75° C. | Mannose (30%) | DMU[c] (70%) | — |
| 77° C. | Sorbitol (40%) | DMU (60%) | — |
| 77° C. | α-Cyclodextrin (30%) | DMU[c] (70%) | — |
| 65° C. | Citric acid (40%) | DMU[c] (60%) | — |

[a]Melting points are at normal pressure in air.
[b]w/w percent of the compounds in the mixture.
[c]DMU = N,N-dimethylurea Suitable compositions disclosed also include the following: Fructose/DMU(70:30); Maltose/DMU/$NH_4Cl$ (50:40:10); Lactose/DMU/$NH_4Cl$ (60:30:10); Mannitol/DMU/$NH_4Cl$ (50:40:10); Glucose/urea/$CaCl_2$ (50:40:10); Sorbitol/DMU/$NH_4Cl$ (70:20:10); Citric acid/DMU (40:60); α-Cyclodextrin/DMU (30:70). The ratios given are weight ratios.

As will be appreciated from the foregoing, the ionic liquids employed may be of the class where an organic salt or urea is mixed with a covalent organic compound, such as a sugar or the like. Without intending to be bound by theory, in many cases it is believed that the organic compound acts as a hydrogen bond-complexing agent which interacts with the anion of the salt or other organic compound to depress the freezing point of the mixture, thereby stabilizing the liquid state. Exemplary covalent compounds which may be suitable components for the LTILs used in connection with the invention include: urea; dimethyl urea; allyl urea; thoiourea; triflouroacetic acid; trichloroacetic acid; citric acid; mandelic acid; valeric acid; tartaric acid; phenyl acetic acid; m-nitrobenzoic acid; glutamic acid, m-aminobenzoic acid, acetamide; salicylamide; benzamide; glyoxylic acid; benzoic acid; malonic acid; oxalic acid; benzyl alcohol; ethanediol; triethanolamine; 2-chloroethanol; vanillin, p-hydroxybenzaldehyde; (alkyl)phenols; glycerol; sugars such as fructose, sorbitol, glucose, or the like; amino compounds such as aniline, diaminoethane; 1,2-diaminopropane, and combinations thereof Combinations of the foregoing covalent compounds are likewise useful in the LTILs employed. Moreover, it is seen in Table 1 above that stable, low melting liquids may be prepared from suitable organic compounds without ionic ingredients, for example, suitable mixtures of urea and fructose or suitable mixtures of urea and citric acid exhibiting the foregoing characteristics in terms of freezing point depression and vapor pressure. These liquids are referred to herein as low melting quasi-ionic liquids.

Low-melting quasi-ionic liquids, refers to molten compositions that form stable liquids at temperatures of less than 100° C. at ambient pressure. Generally, such liquids have very low vapor pressure at 100° C., less than 75 mBar or so and preferably less than 50 mBar or 25 mBar at 100° C. Most suitable liquids will have a vapor pressure of less than 10 mBar at 100° C. and often the vapor pressure is so low it is negligible and is not easily measurable since it is less than 1 mBar at 100° C. These liquids are mixtures of two or more compounds, such as a urea/fructose mixture which remain liquid upon cooling, preferably at least to 100° C. Still more preferably, the low-melting quasi-organic liquids used in connection with the invention have melting points of less than 75° C. Low-melting quasi-organic liquids useful in connection with the present invention typically exhibit significant freezing point depressions as compared with the rule of mixtures melting point of the constituent compounds. Preferred low-melting quasi-organic liquids ionic liquids exhibit a freezing point depression of at least 25° C., preferably 75° C., and more preferably at least 150° C., based on the melting points and amounts of the individual components.

Especially preferred liquids include the eutectic mixture of choline chloride and urea (53.4 wt % and 46.6 wt %, respectively) which is clear, colorless, stable fluid at room temperature. Others are fluid at higher temperatures. For example, the fluid comprised of 60 wt % fructose and 40% urea melts at 65° C. and the fluid comprised of 70 wt % sorbitol, 20 wt % urea, and 10 wt % ammonium chloride melts at 67° C. These fluids have low volatility and excellent thermal stability (e.g., as high as 220° C.) and are likewise suitable.

Still further details as to suitable liquids are found in the following documents, the disclosures of which are incorporated by reference in their entireties: U.S. Pat. No. 7,053,232, issued May 30, 2006, entitled "Lewis Acid Ionic Liquids", to Moulton; U.S. Pat. No. 6,900,313, issued May 31, 2005, entitled "Chiral Ionic Liquids", to Wasserscheid et al.; and U.S. Pat. No. 6,573,405, issued Jun. 3, 2003, entitled "Ionic Liquids", to Abbott et al.

FIG. 1 is a schematic diagram of a papermachine 10 having a conventional twin wire forming section 12, a felt run 14, a shoe press section 16 a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish issuing therefrom as a jet in the machine direction to a nip 42 between forming roll 38 and roll 26 and the fabrics. The furnish forms a nascent web 44 which is dewatered on the fabrics with the assistance of vacuum, for example, by way of suction box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll it may have a consistency of 10-25 percent, preferably 20 to 25 percent or so as it enters nip 58 between shoe press roll 56 and transfer roll 60. Transfer roll 60 may be a heated roll if so desired. It has been found that increasing steam pressure to roll 60 helps lengthen the time between required stripping of excess adhesive from the cylinder of Yankee dryer 20. Suitable steam pressure may be about 95 psig or so, bearing in mind that roll 60 is a crowned roll and roll 70 has a negative crown to match such that the contact area between the rolls is influenced by the pressure in roll 60. Thus, care must be exercised to maintain matching contact between rolls 60, 70 when elevated pressure is employed.

Instead of a shoe press roll, roll 56 could be a conventional suction pressure roll. If a shoe press is employed, it is desirable and preferred that roll 54 is a vacuum roll effective to remove water from the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at 58, typically by increasing the consistency by 15 or more points at this stage of the process. The configuration shown at 58 is generally termed a shoe press; in connection with the present invention, cylinder 60 is operative as a transfer cylinder which operates to convey web 44 at high speed, typically 1000 fpm-6000 fpm, to the creping fabric.

Cylinder 60 has a smooth surface 64 which may be provided with adhesive (the same as the creping adhesive coating used on the Yankee cylinder) and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of papermachine 10; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 as shown in the diagram.

Fabric 18 is supported on a plurality of rolls 68, 70, 72 and a press nip roll 74 and forms a fabric crepe nip 76 with transfer cylinder 60 as shown.

The creping fabric defines a creping nip over the distance in which creping fabric 18 is adapted to contact roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction.

Creping nip 76 generally extends over a fabric creping nip distance of anywhere from about ⅛" to about 2", typically ½" to 2". For a creping fabric with 32 CD strands per inch, web 44 thus will encounter anywhere from about 4 to 64 weft filaments in the nip.

The nip pressure in nip 76, that is, the loading between backing roll 70 and transfer roll 60 is suitably 20-200, preferably 40-70 pounds per linear inch (PLI).

After fabric creping, the web continues to advance along MD 66 where it is wet-pressed onto Yankee cylinder 80 in transfer nip 82. Optionally, the web is treated by way of a suction box 45.

Transfer at nip 82 occurs at a web consistency of generally from about 25 to about 70 percent. At these consistencies, it is difficult to adhere the web to surface 84 of cylinder 80 firmly enough to remove the web from the fabric thoroughly. This aspect of the process is important, particularly when it is desired to use a high velocity drying hood.

The inventive coatings cooperate with a moderately moist web (25-70 percent consistency) to adhere it to the Yankee sufficiently to allow for high velocity operation of the system and high jet velocity impingement air drying and subsequent peeling of the web from the Yankee. In this connection, a poly(vinyl alcohol)/polyamide or PAE aqueous adhesive composition is applied at 86 as needed, co-sprayed with a low temperature ionic fluid preferably at a collective add-on rate of less than about 40 mg/m$^2$ of sheet. The conventional adhesive composition may be applied separately from the low temperature ionic fluid, i.e. using separate spray booms, or the components can be combined in any suitable manner that will be amenable to maintaining the ionic liquid/adhesive composition on surface 64 of drying cylinder 60.

The web is dried on Yankee cylinder 80 which is a heated cylinder and by high jet velocity impingement air in Yankee hood 88. Hood 88 is capable of variable temperature. During operation, temperature may be monitored at wet end A of the Hood and dry end B of the hood using an infra-red detector or any other suitable means if so desired. As the cylinder rotates, web 44 is peeled from the cylinder at 89 and wound on a take-up reel 90. Reel 90 may be operated 5-30 fpm (preferably 10-20 fpm) faster than the Yankee cylinder at steady-state when the line speed is 2100 fpm, for example. A creping doctor C is normally used and a cleaning doctor D mounted for intermittent engagement is used to control build up. When adhesive build-up is being stripped from Yankee cylinder 80 the web is typically segregated from the product on reel 90, preferably being fed to a broke chute at 100 for recycle to the production process.

Instead of being peeled from cylinder 80 at 89 during steady-state operation as shown, the web may be creped from dryer cylinder 80 using a creping doctor such as creping doctor C, if so desired.

EXAMPLE

A 3"×5" stainless steel plate (Q-Panel, Type S) was coated with a eutectic ionic liquid comprised of 1 mol choline chloride and 2 mol urea followed by the creping adhesive Nalco 690HA. The latter is known to harden to films exhibiting little to no tack under high temperature. A control stainless steel plate was prepared in the same manner except without the ionic liquid. Both coated plates were heated to 125° C. for 45 min in a forced air oven. The films were then tested for dry tack using the "Thumb Test". Table 3 shows the coating weights and tack results for the treatments.

TABLE 3

Adhesion Data

| | Coating wt (g) | | |
|---|---|---|---|
| Run | IL | 690HA | Dry Tack |
| Control | 0 | 0.051 | slight |
| Control | 0 | 0.24 | slight |
| Invention | 0.126 | 0.044 | higher[1] |
| Invention | 0.119 | 0.27 | higher[1] |

[1]Slightly higher than control as indicated by ability to lift plate higher with thumb While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A creping adhesive coating on a drying cylinder of a papermaking machine comprising a creping adhesive resin composition and a low temperature ionic liquid or a low temperature quasi-ionic liquid, the liquid being characterized by a melting temperature of 100° C. or less, wherein the ionic or quasi ionic liquid is an urea compound, a carbohydrate, a polyol, a carboxylic acid, an organic ammonium salt or any combination thereof.

2. The creping adhesive coating according to claim 1, wherein the ionic or quasi-ionic liquid has a melting temperature of 25° C. or less.

3. The creping adhesive coating according to claim 1, wherein the ionic or quasi-ionic liquid exhibits a vapor pressure of less than 75 mBar at 100° C.

4. The creping adhesive coating according to claim 1, wherein the ionic or quasi-ionic liquid exhibits a vapor pressure of less than 25 mBar at 100° C.

5. The creping adhesive coating according to claim 1, wherein the ionic or quasi-ionic ionic liquid exhibits a vapor pressure of less than 1 mBar at 100° C.

6. The creping adhesive coating according to claim 1, wherein the ionic or quasi-ionic liquid exhibits a freezing point depression of at least 75° C.

7. The creping adhesive coating according to claim 1, wherein the ionic or quasi-ionic liquid comprises a urea compound selected from urea and dimethyl urea.

8. The creping adhesive coating according to claim 1, wherein the ionic or quasi-ionic liquid comprises a compound selected from carbohydrates, polyols and carboxylic acids.

9. The creping adhesive coating according to claim 1, wherein the ionic or quasi-ionic liquid comprises sorbitol.

10. The creping adhesive coating according to claim 1, wherein the low temperature ionic liquid comprises an organic ammonium salt.

11. The creping adhesive coating according to claim 10, wherein the organic ammonium salt is a choline salt.

12. The creping adhesive coating according to claim 1, wherein the low temperature ionic liquid consists essentially of a choline salt and urea.

13. The creping adhesive coating according to claim 1, wherein the low temperature ionic liquid consists of the eutectic mixture of choline chloride (53.4 wt. %) and urea (46.6 wt. %) having a melting point of about 12° C.

14. The creping adhesive coating according to claim 1, wherein the low temperature, quasi-ionic liquid consists essentially of fructose and urea.

15. The creping adhesive coating according to claim 1, wherein the low temperature quasi-ionic liquid consists of about 60 wt. % fructose and about 40 wt. % urea.

16. The creping adhesive coating according to claim 1, wherein the low temperature ionic liquid consists essentially of an ammonium salt, a saccharide and a urea compound selected from urea and dimethyl urea.

17. The creping adhesive coating according to claim 1, wherein the low temperature ionic liquid consists of a mixture of about 70 wt. % sorbitol, about 20 wt. % urea and about 10 wt. % ammonium chloride.

18. The creping adhesive coating according to claim 1, wherein the creping adhesive resin composition comprises a mixture of polyvinyl alcohol and a polyamidoamine-epichlorohydrin resin.

19. A coating composition for use in the manufacture of paper tissue or paper towel consisting essentially of a low temperature ionic liquid or a low temperature quasi-ionic liquid, the liquid being characterized by a melting temperature of 100° C. or less and an adhesive resin composition selected from the group consisting of polyamidoamine-epichlorohydrin resins, polyvinylalcohol resins and combinations thereof.

20. The coating composition according to claim 19, wherein the creping adhesive resin composition comprises a pre-crosslinked polyamidoamine-epichlorihydrin resin.

21. A creping adhesive coating on a drying cylinder of a papermaking machine consisting essentially of a creping adhesive resin composition and a low temperature ionic liquid or a low temperature quasi-ionic liquid, the liquid being characterized by a melting temperature of 100° C. or less, wherein the creping adhesive resin is a polyamidoamine-epichlorohydrin resin, a polyamide-epichlorohydrin resin, a poly(diallyamine-epichlorohydrin resin, a polyalkylene polyamine-epichlorohydrin resin, a reaction product of an epihalohydrin and an end-capped polyaminamide polymer, a polyalkanolamide, a reaction product of (a) a mixture of polyamide and at least one of polyvinyl alcohol and low molecular weight polyethyleneimine and (b) epihalohydrin, poly(vinyl alcohol), poly(vinyl alcohol) copolymers, polyacrylamide, polymethacrylamide, a partially hydrolyzed polymethacrylamide, poly(N-vinyl pyrrolidinone), polyvinylamine, polyethyleneimine, poly(ethylene oxide), poly(ethylene glycol), ethylene-vinyl acetate copolymer, hydroxyethyl cellulose, hydroxypropyl cellulose, guar gum, starch, agar, alginic acid, chitosan, carboxymethyl cellulose, highly branched polyamidoamines, or a silyl-linked polymer.

22. The creping adhesive coating according to claim 21, wherein the ionic or quasi-ionic liquid has a melting temperature of 25° C. or less.

23. The creping adhesive coating according to claim 21, wherein the ionic or quasi-ionic liquid exhibits a vapor pressure of less than 75 mBar at 100° C.

24. The creping adhesive coating according to claim 21, wherein the ionic or quasi-ionic liquid exhibits a vapor pressure of less than 25 mBar at 100° C.

25. The creping adhesive coating according to claim 21, wherein the ionic or quasi-ionic liquid exhibits a vapor pressure of less than 1 mBar at 100° C.

26. The creping adhesive coating according to claim 21, wherein the ionic or quasi-ionic liquid exhibits a freezing point depression of at least 75° C.

27. The creping adhesive coating according to claim 21, wherein the low temperature ionic liquid is 1-ethyl-3-methyl imidazolium acetate.

28. The creping adhesive coating according to claim 21, wherein the low temperature ionic liquid comprises an anion selected from halide anions, alkylsulfonate anions, hydrogen sulfate anions, alkyl sulfate anions and acetate anions.

29. The creping adhesive coating according to claim 28, wherein the ionic liquid comprises a methylimidazolium cation.

30. The creping adhesive coating according to claim 21, wherein the low temperature ionic liquid comprises a cation selected from alkylimidazolium cations and alkylpyrazolium cations.

31. A method of making absorbent cellulosic sheet comprising:

(a) preparing an aqueous furnish comprising papermaking fibers;

(b) applying a creping adhesive coating to a heated, rotating drying cylinder, the adhesive coating consisting essentially of a creping adhesive coating resin composition and a low temperature ionic liquid or a low temperature quasi-ionic liquid, the liquid being characterized by a melting temperature of 100° C. or less, wherein the creping adhesive coating resin is a polyamidoamine-epichlorohydrin resin, a polyamide-epichlorohydrin resin, a poly(diallyamine)-epichlorohydrin resin, a polyalkylene polyamine-epichlorohydrin resin, a reaction product of an epihalohydrin and an end-capped polyaminamide polymer, a polyalkanolamide, a reaction product of (a) a mixture of polyamide and at least one of polyvinyl alcohol and low molecular weight polyethyleneimine and (b) epihalohydrin, poly(vinyl alcohol), poly(vinyl alcohol) copolymers, polyacrylamide, polymethacrylamide, a partially hydrolyzed polymethacrylamide, poly(N-vinyl pyrrolidinone), polyvinylamine, polyethyleneimine, poly(ethylene oxide), poly(ethylene glycol), ethylene-vinyl acetate copolymer, hydroxyethyl cellulose, hydroxypropyl cellulose, guar gum, starch, agar, alginic acid, chitosan, carboxymethyl cellulose, highly branched polyamidoamines, or a silyl-linked polymer;

(c) depositing the aqueous furnish on a foraminous support to form a nascent web;

(d) transferring the nascent web to the heated, rotating drying cylinder such that it is adhered thereto by way of the adhesive coating on the drying cylinder;

(e) drying the web; and (f) removing the dried web from the heated, rotating drying cylinder.

32. The method according to claim 31, wherein the creping adhesive coating is applied to the creping cylinder by way of a spraying a low temperature ionic liquid or a low temperature quasi-ionic liquid onto the heated, rotating drying cylinder and co-spraying an aqueous adhesive resin composition onto the heated, rotating drying cylinder.

33. The method according to claim 31, wherein the dried web is creped from the drying cylinder with a creping doctor blade.

34. The method according to claim 31, wherein the dried web is peeled from the creping cylinder.

35. The method according to claim 31, wherein the nascent web is dried to a consistency of at least 30% prior to transfer to the creping cylinder.

36. A wetable creping adhesive consisting essentially of a creping adhesive resin composition and a low temperature ionic liquid or a low temperature quasi-ionic liquid, the liquid being characterized by a melting temperature of 100° C. or less, wherein:

the adhesive resin composition is a polyamidoamine-epichlorohydrin resin, a polyvinylalcohol resin or a combination thereof, and the low temperature ionic liquid is a cation selected from alkylimidazolium cations and alkylpyrazolium cations.

37. A method of making absorbent cellulosic sheet comprising:

(a) preparing an aqueous furnish comprising papermaking fibers;

(b) applying a creping adhesive coating to a heated, rotating drying cylinder, the adhesive coating comprising a creping adhesive resin composition and a low temperature ionic liquid or a low temperature quasi-ionic liquid, the liquid being characterized by a melting temperature of 100° C. or less, the ionic or quasi ionic liquid being an urea compound, a carbohydrate, a polyol, a carboxylic acid, an organic ammonium salt or any combination thereof;

(c) depositing the aqueous furnish on a foraminous support to form a nascent web;

(d) transferring the nascent web to the heated, rotating drying cylinder such that it is adhered thereto by way of the adhesive coating on the drying cylinder;

(e) drying the web; and (f) removing the dried web from the heated, rotating drying cylinder.

* * * * *